US007837021B2

(12) United States Patent
Ichikawa et al.

(10) Patent No.: US 7,837,021 B2
(45) Date of Patent: Nov. 23, 2010

(54) PASSENGER CONVEYOR

(75) Inventors: Fumio Ichikawa, Tokyo (JP); Hideki Anshita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 305 days.

(21) Appl. No.: 12/090,296

(22) PCT Filed: Sep. 1, 2006

(86) PCT No.: PCT/JP2006/317367

§ 371 (c)(1),
(2), (4) Date: Apr. 15, 2008

(87) PCT Pub. No.: WO2008/026294

PCT Pub. Date: Mar. 6, 2008

(65) Prior Publication Data

US 2009/0159397 A1 Jun. 25, 2009

(51) Int. Cl.
*B65G 23/24* (2006.01)
*B66B 23/16* (2006.01)
*B65G 23/44* (2006.01)

(52) U.S. Cl. ..... 198/329; 198/813; 198/815

(58) Field of Classification Search ..... 198/321–338, 198/810.04, 813–817; 60/477, 478
See application file for complete search history.

(56) References Cited

U.S. PATENT DOCUMENTS 872,327 A * 12/1907 Brown ..... 60/477
1,741,842 A * 12/1929 Holtschmit ..... 198/329
2,438,068 A * 3/1948 Mercier ..... 198/813
2,788,883 A * 4/1957 Schwenk ..... 198/813
3,859,791 A * 1/1975 Allen et al. ..... 60/477
3,901,563 A * 8/1975 Day ..... 305/146
3,946,619 A * 3/1976 Needles et al. ..... 37/423
4,007,826 A * 2/1977 Brown et al. ..... 198/813

(Continued)

FOREIGN PATENT DOCUMENTS

EP 547737 A2 * 6/1993

(Continued)

*Primary Examiner*—Gene Crawford
*Assistant Examiner*—William R Harp
(74) *Attorney, Agent, or Firm*—Oblon, Spivak, McClelland, Maier & Neustadt, L.L.P.

(57) ABSTRACT

Obtained is a passenger conveyor that, in the case of the elongation of a step chain of the passenger conveyor, causes a hydraulic cylinder to move a lower-part step chain wheel, thereby absorbing a slack in the step chain and tensioning the step chain with any push-out force. In a passenger conveyor provided with a step chain tensioning device that, in the case of the elongation of a step chain, causes a lower-part step chain wheel to move, thereby absorbing a slack in the step chain and tensioning the step chain with any tensioning force, the step chain tensioning device includes a tensioning device section, which has a hydraulic cylinder and pushes out the lower-part step chain wheel with a push-out force of the hydraulic cylinder on a side where the step chain is tensioned, and a pressure device section, which has a pressure piston to which a load by a weight is applied and causes the hydraulic cylinder of the tensioning device section to constantly give any tension to the step chain via a hydraulic oil due to the pressure of the pressure piston.

12 Claims, 14 Drawing Sheets

U.S. PATENT DOCUMENTS

| | | | | |
|---|---|---|---|---|
| 4,284,192 | A * | 8/1981 | Taylor | 198/813 |
| 4,466,803 | A * | 8/1984 | Wilson | 474/138 |
| 4,955,195 | A * | 9/1990 | Jones et al. | 60/405 |
| 7,117,989 | B2 * | 10/2006 | Weigel et al. | 198/810.04 |
| 2004/0040296 | A1 * | 3/2004 | Fan | 60/477 |

FOREIGN PATENT DOCUMENTS

| | | |
|---|---|---|
| JP | 46 1900 | 1/1971 |
| JP | 52 80979 | 6/1977 |
| JP | 54 65190 | 5/1979 |
| JP | 54 133592 | 10/1979 |
| JP | 6 48675 | 2/1994 |
| JP | 2536774 | 5/1997 |
| JP | 10 87252 | 4/1998 |

* cited by examiner

PASSENGER CONVEYOR

TECHNICAL FIELD

The present invention relates to a passenger conveyor provided with a step chain tensioning device that constantly gives any tensioning force to a step chain of an escalator, a moving walk and the like.

BACKGROUND ART

There is known a conventional method of absorbing the slack of a step chain of a passenger conveyor and giving tension to the step chain. In this method, a lower-part step chain wheel on which the step chain is wound is provided with an urging device that compresses a spring and tensions the step chain with any tensile force, the lower-part step chain wheel is moved by being pulled with the urging force of the spring when elongation has occurred in the step chain, whereby the slack of the step chain is absorbed and the step chain is tensioned with any tensile force (refer to Patent Document 1, for example).

There is also known a method that involves causing a controller to actuate a motor-driven hydraulic pump when the elongation of a step chain has been detected, pushing out a hydraulic cylinder directly connected to a lower-part step chain wheel by a hydraulic oil, whereby tension is applied to the step chain and the elongation of the step chain is absorbed (refer to Patent Document 2, for example).

[Patent Document 1]: Japanese Utility Model Laid-Open No. 54-133592

[Patent Document 2]: Japanese Patent Laid-Open No. 10-87252

DISCLOSURE OF THE INVENTION

Problems to be Solved by the Invention

In the conventional method in which an urging device that compresses a spring and tensions the step chain with any tensile force is provided, because the elongation of the step chain is absorbed, the compression length of the spring increases and the urging force of the spring decreases. Therefore, the tension that tensions the step chain decreases. Therefore, it is necessary to constantly perform inspection and maintenance for maintaining a given tensioning force in order to compress the spring in an appropriate condition and to give an appropriate tensioning force to the step chain. As described above, it is necessary to perform inspection and adjustment each time during the maintenance and inspection of a passenger conveyor. Because the step chain tensioning devices on the right and left sides are independent from each other, it is necessary to perform the fastening of the springs so that no difference occurs in the tensioning force on the right and left sides. The spring adjustment during maintenance and inspection is performed in a work space between a reversal portion of the step and a truss end portion. However, when it becomes necessary to reduce the installation space within the building of the passenger conveyor, this results in a decrease in the work space and the configuration of the step chain tensioning device is limited thereby.

Furthermore, because in the conventional method, as means of bringing the step chain tensioning device into action, a hydraulic cylinder is actuated by use of a motor-driven hydraulic pump and the step chain is tensioned, a hydraulic pump is actuated by a motor and hence an electric source for power is necessary. This poses the problems that large-scale configuration and control are necessary and that the cost increases also.

The present invention has been made to solve problems as described above, and provides a passenger conveyor that, in the case of the elongation of a step chain of the passenger conveyor, causes a hydraulic cylinder of a step chain tensioning device to move a lower-part step chain wheel, thereby absorbing a slack in the step chain and tensioning the step chain with any push-out force.

Means for Solving the Problems

The passenger conveyor related to the present invention is a passenger conveyor provided with a step chain tensioning device that, in the case of the occurrence of elongation in a step chain of the passenger conveyor, moves a lower-part step chain wheel on which the step chain is wound, thereby absorbing a slack in the step chain and tensioning the step chain with any tensioning force, which is characterized in that the step chain tensioning device comprises a tensioning device section, which has a hydraulic cylinder and pushes out the lower-part step chain wheel with a push-out force of the hydraulic cylinder on a side where the step chain is tensioned, and a pressure device section, which has a pressure piston to which a load by a weight is applied and causes the hydraulic cylinder of the tensioning device section to constantly give any tension to the step chain via a hydraulic oil due to the pressure of the pressure piston.

Advantages of the Invention

According to the present invention, the inspection and maintenance work of a step chain tensioning device is easy and working hours can be substantially shortened. Furthermore, the tension of the tensioning device can always be held at any given value and the adjustment of the tension can also be easily performed. Also, the tension can be easily visually observed with a pressure gauge. Because the push-out force is uniformly applied to the tensioning devices on the right and left sides, it is possible to improve the operation performance of the passenger conveyor. Also, a work space between a reversal portion of the step and a truss end portion can be reduced and the shortening of a lower-part truss can be achieved. Electric power is unnecessary.

DESCRIPTION OF SYMBOLS

Figure 1:
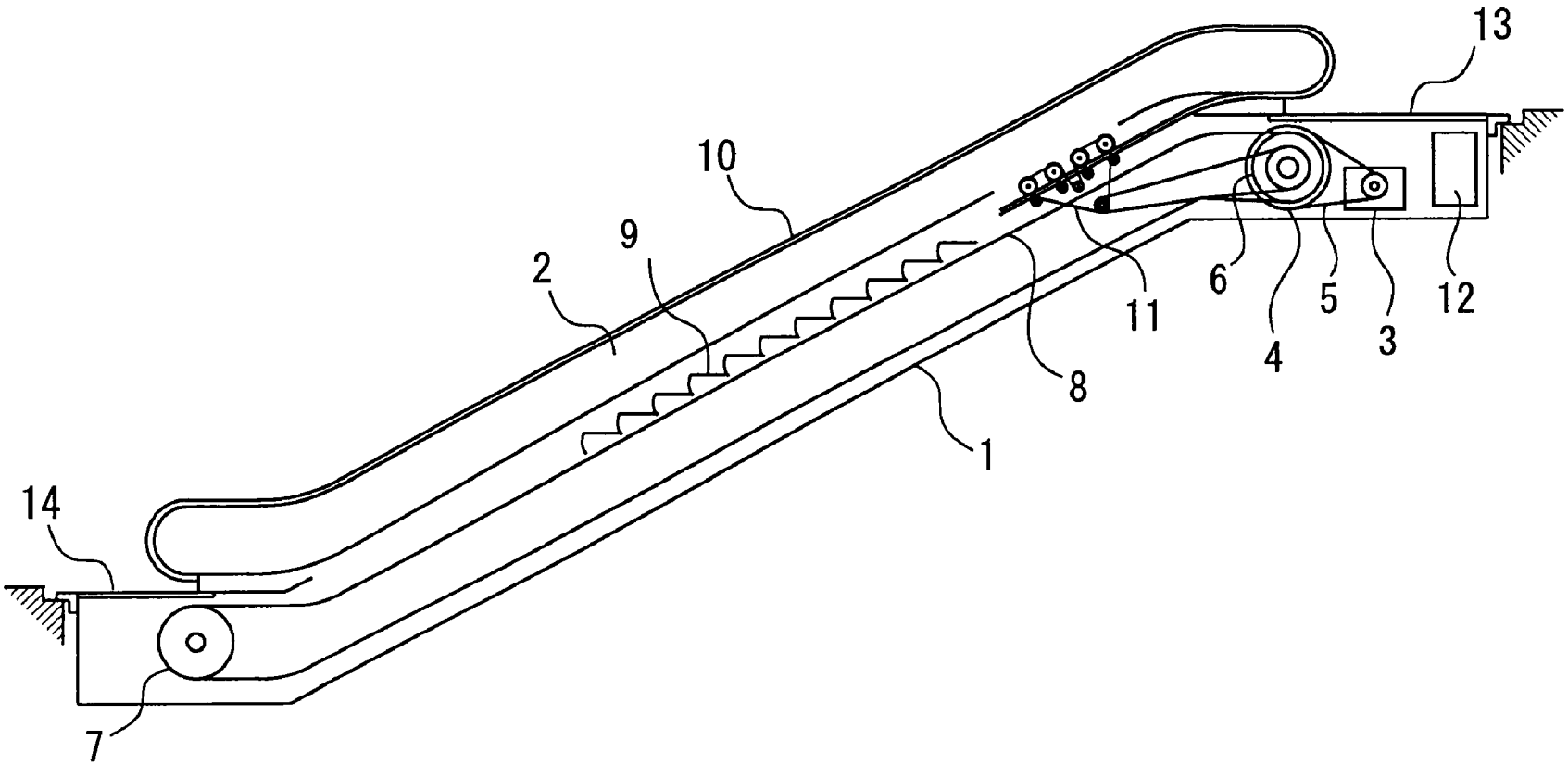
FIG. 1 is a general side view to explain the rough construction of a general passenger conveyor.

1 Main frame (truss)
2 Balustrade
3 Driving machine
4 Driving chain wheel
5 Driving chain
6 Upper-part step chain wheel
7 Lower-part step chain wheel
8 Step chain
9 Step
10 Handrail
11 Handrail driving device
12 Control panel
13 Upper-part landing entrance
14 Lower-part landing entrance
20 Tensioning device section
21 Pressure device section
22 Lower-part step chain wheel shaft
23 Block
23*a*, 23*c* Screw hole
23*b* Notch
24 Hydraulic cylinder
24*a* Air vent hole
25 Rod
25*a* Chamfer
25*b* Screw portion
25*c* Slide shaft portion
26 Pressure piston
27 Rod
28 Weight
30, 31 Check valve
32 Manual open/close valve
33 Pressure gauge
34 Hydraulic oil tank
35 Hydraulic oil
40, 41, 42, 43, 83, 84, 85, 86 Piping pipe
50 Weight mounting metal fitting
51, 53, 58, 63 Nut
52 Weight mounting rod
55. Guide mounting metal fitting
56 Weight guide
57 Stud bolt
60 Support metal fitting
61 Guide metal fitting
62 Mounting plate
67, 78 Bolt
68 Maintenance/inspection room
72 Buffer holder
74, 76 Holder
74*a* Base portion
74*b* Guide portion
74*c* Guide hole
75 Spring
76*a* Screw hole
77 Lock nut
80 First flow-direction changeover valve
81 Second flow-direction changeover valve
90 Pressure detection switch
91 Warning panel

BEST MODE FOR CARRYING OUT THE INVENTION

The present invention is described in more detail with reference to the accompanying drawings.

Embodiment 1

Figure 2:
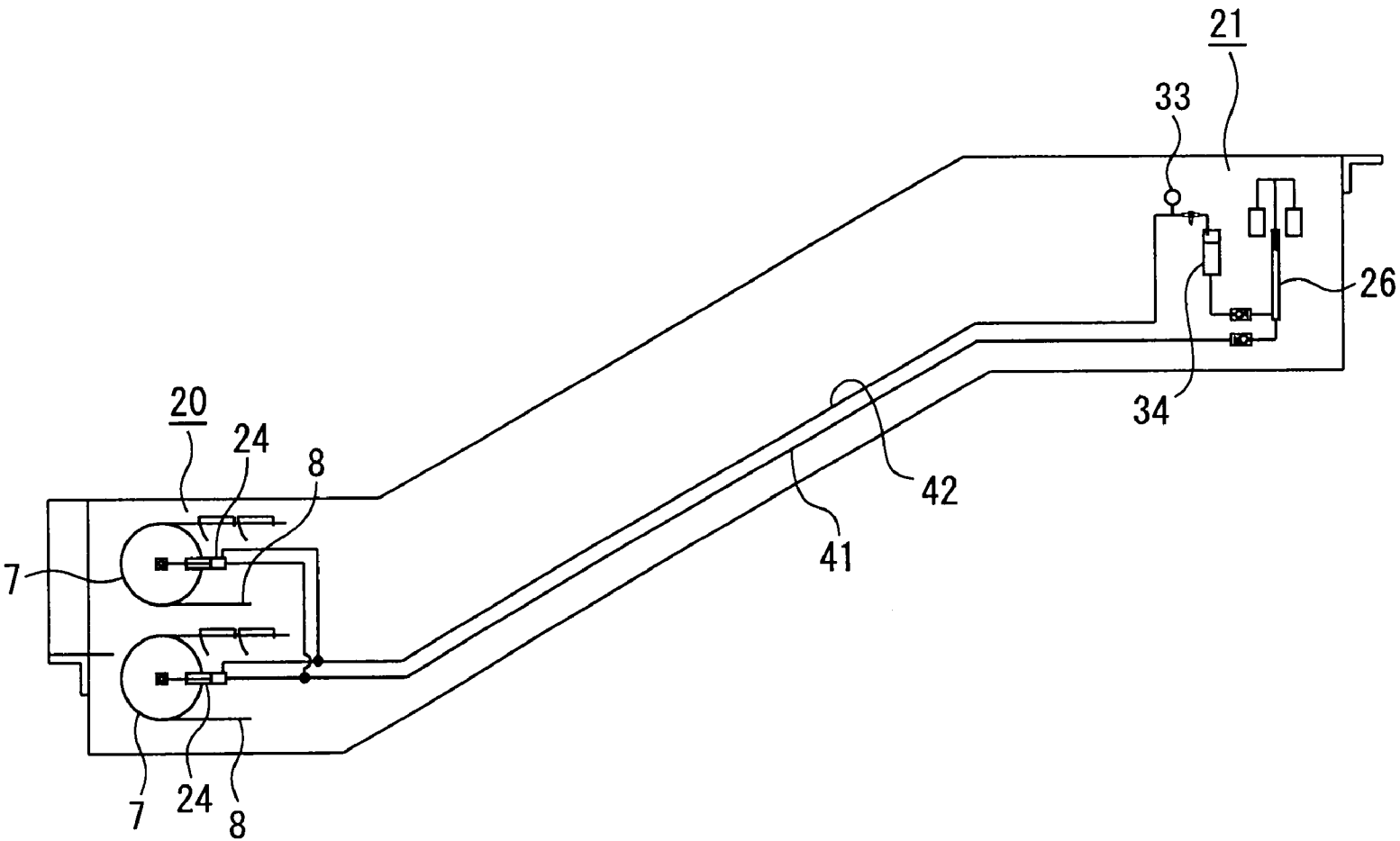
FIG. 2 is a general side view showing the rough construction of a passenger conveyor in Embodiment 1 of the present invention.
Figure 3:
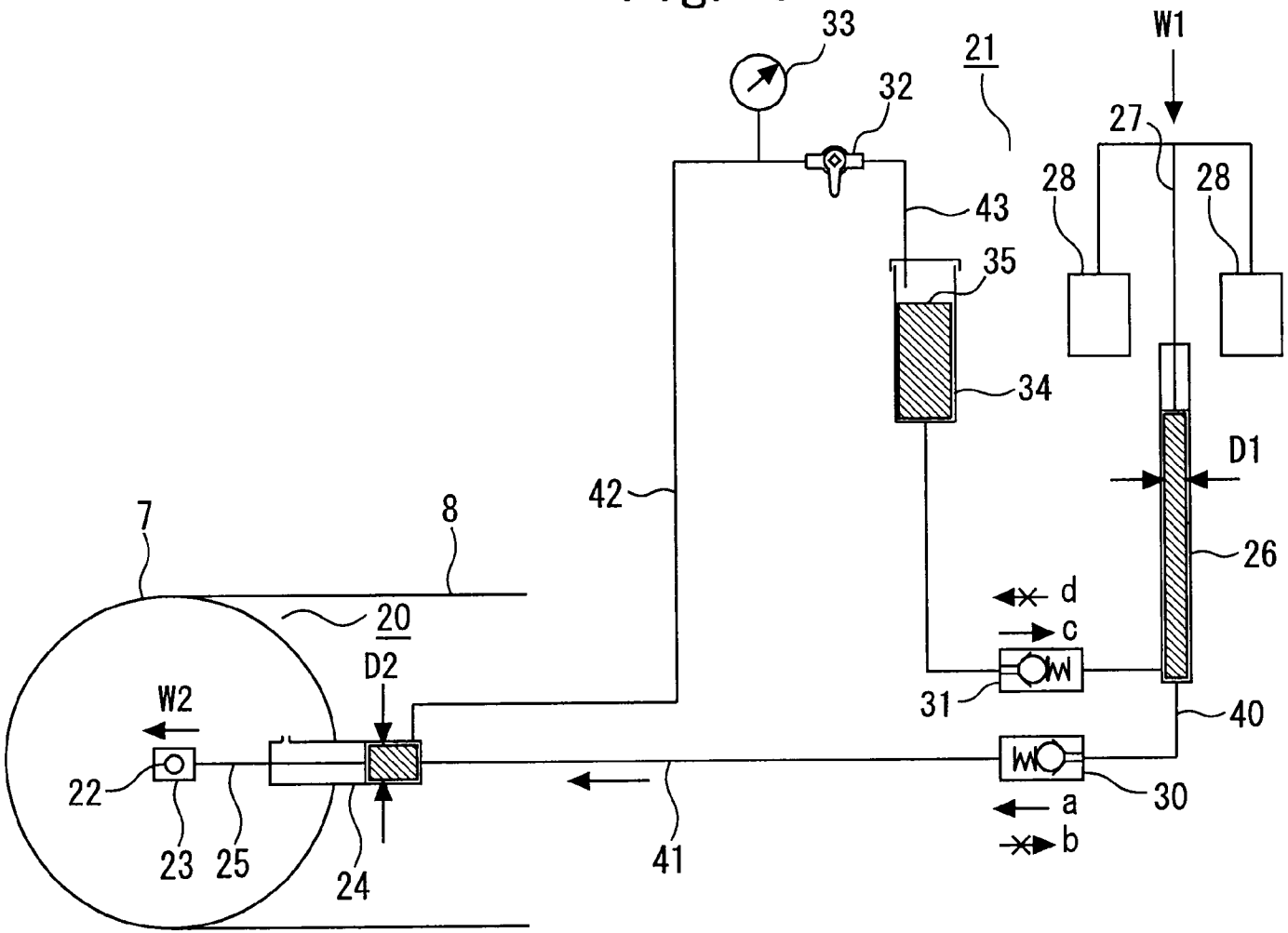
FIG. 3 is side view showing a general block diagram showing a step chain tensioning device of a passenger conveyor in Embodiment 1 of the present invention.
Figure 4:
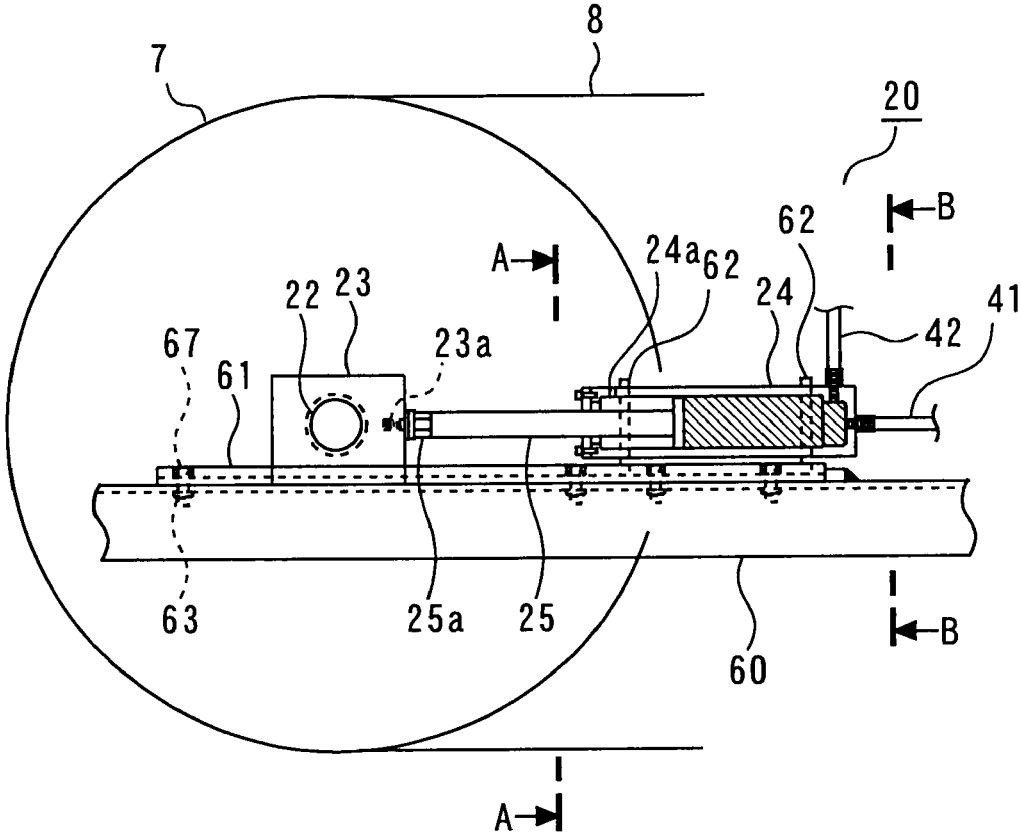
FIG. 4 is a side view showing the detailed configuration of a tensioning device section of a step chain tensioning device.
Figure 5:
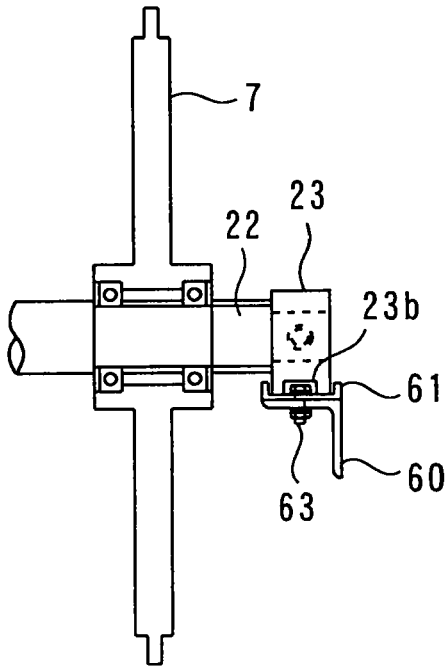
FIG. 5 is a front view of a tensioning device section as viewed from the lower-part truss-end side.
Figure 6:
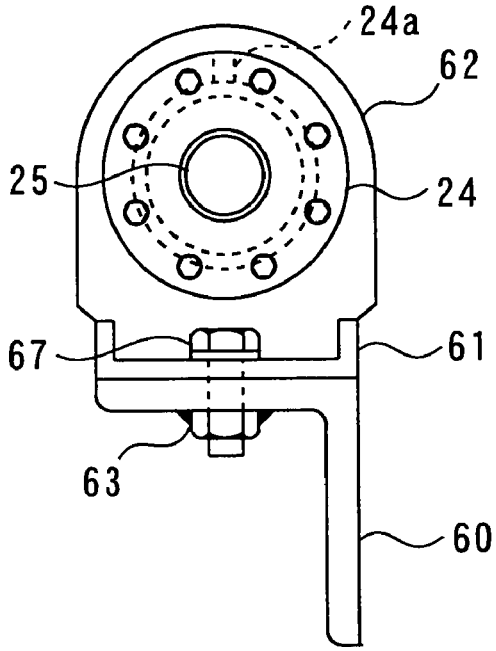
FIG. 6 is a sectional view taken along the line A-A of FIG. 4.
Figure 7:
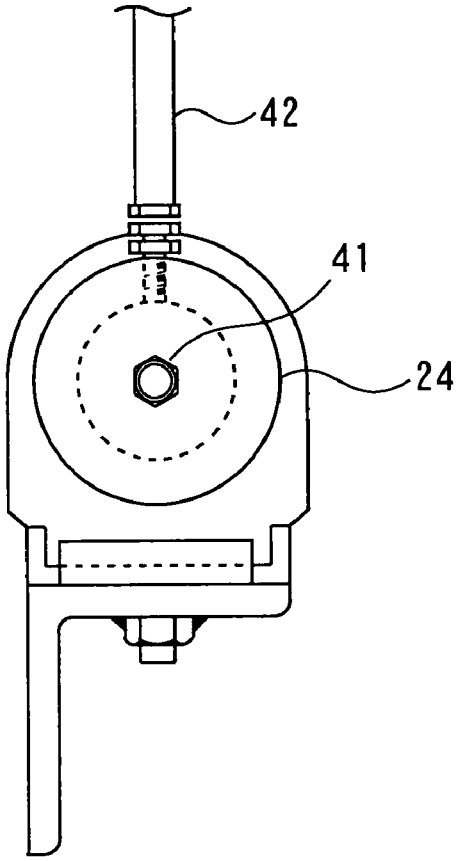
FIG. 7 is a sectional view taken along the line B-B of FIG. 4.
Figure 8:
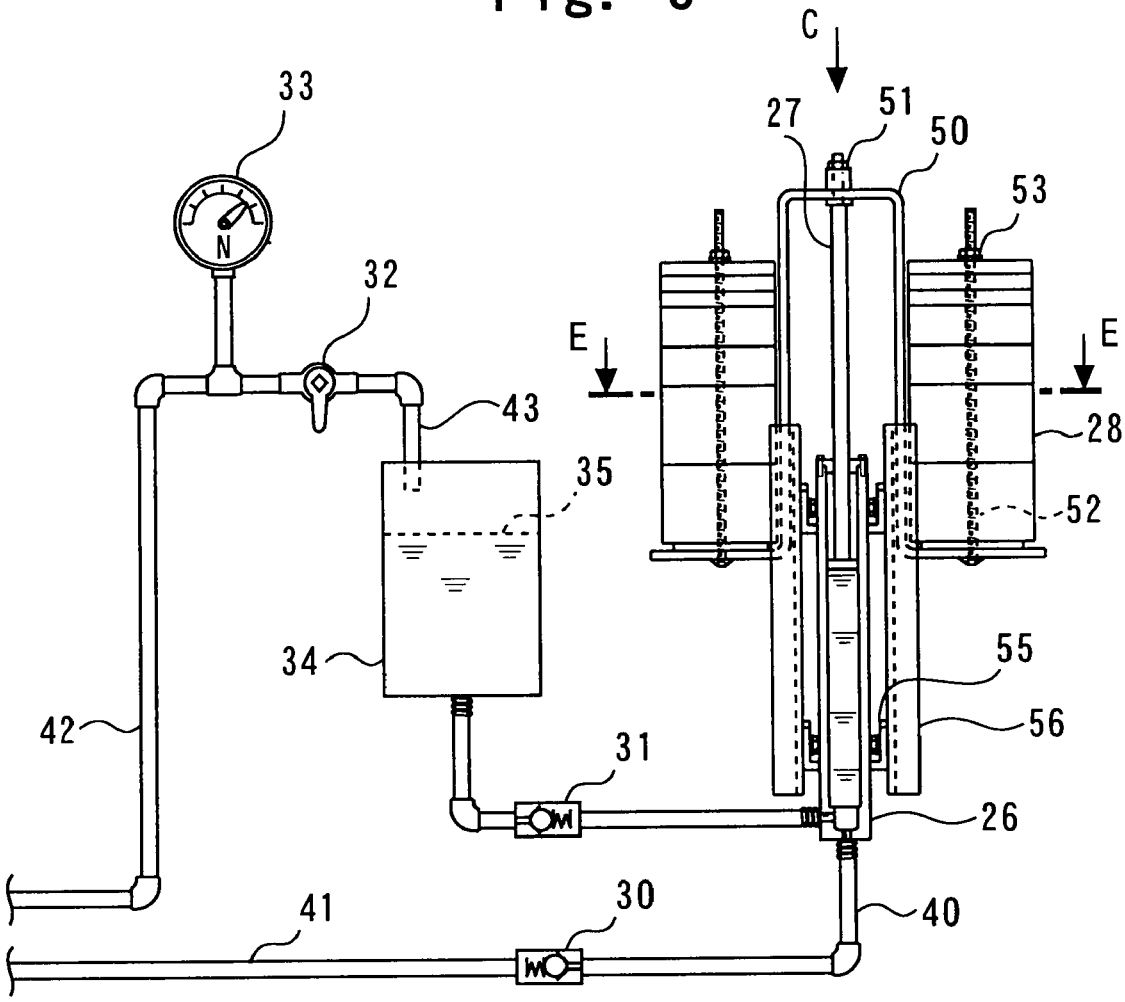
FIG. 8 is a side view showing the detailed configuration of a pressure device section of a step chain tensioning device.
Figure 9:
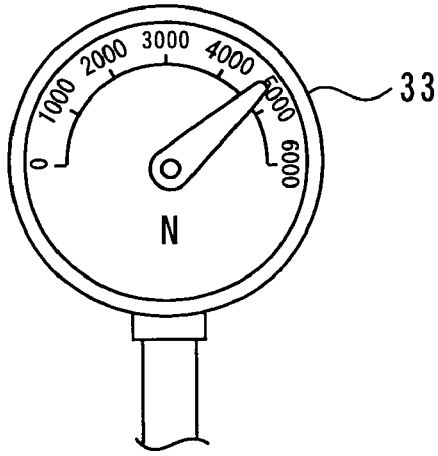
FIG. 9 is an enlarged front view of a pressure gauge indicating tensioning force.
Figure 10:
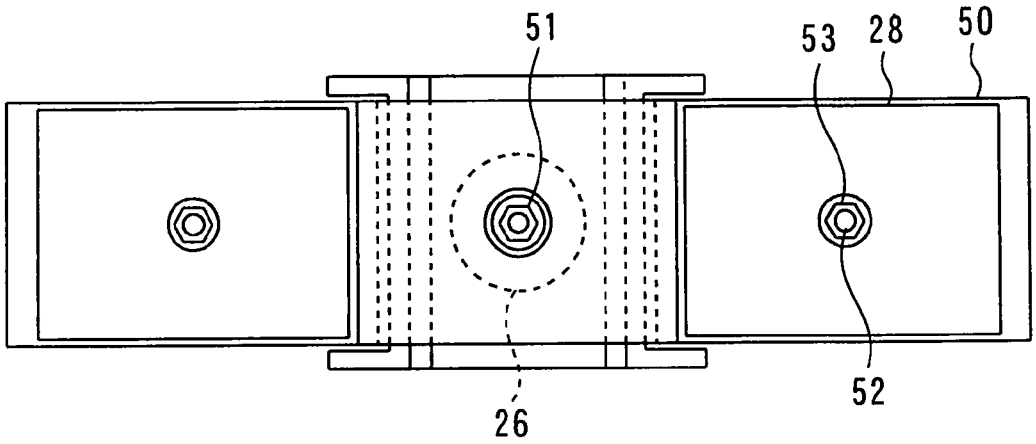
FIG. 10 is a plan view of FIG. 8 as viewed in the direction of the arrow C.
Figure 11:
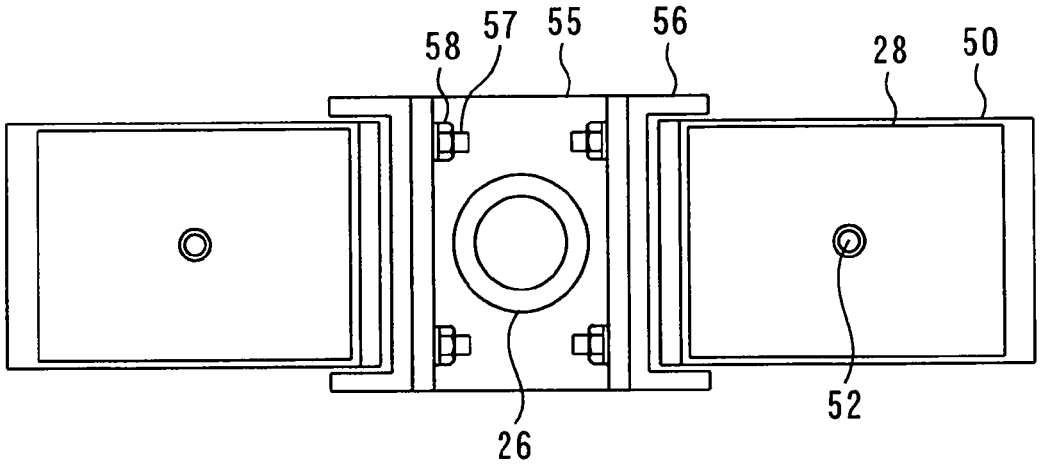
FIG. 11 is a sectional view taken along the line E-E of FIG. 8.
Figure 12:
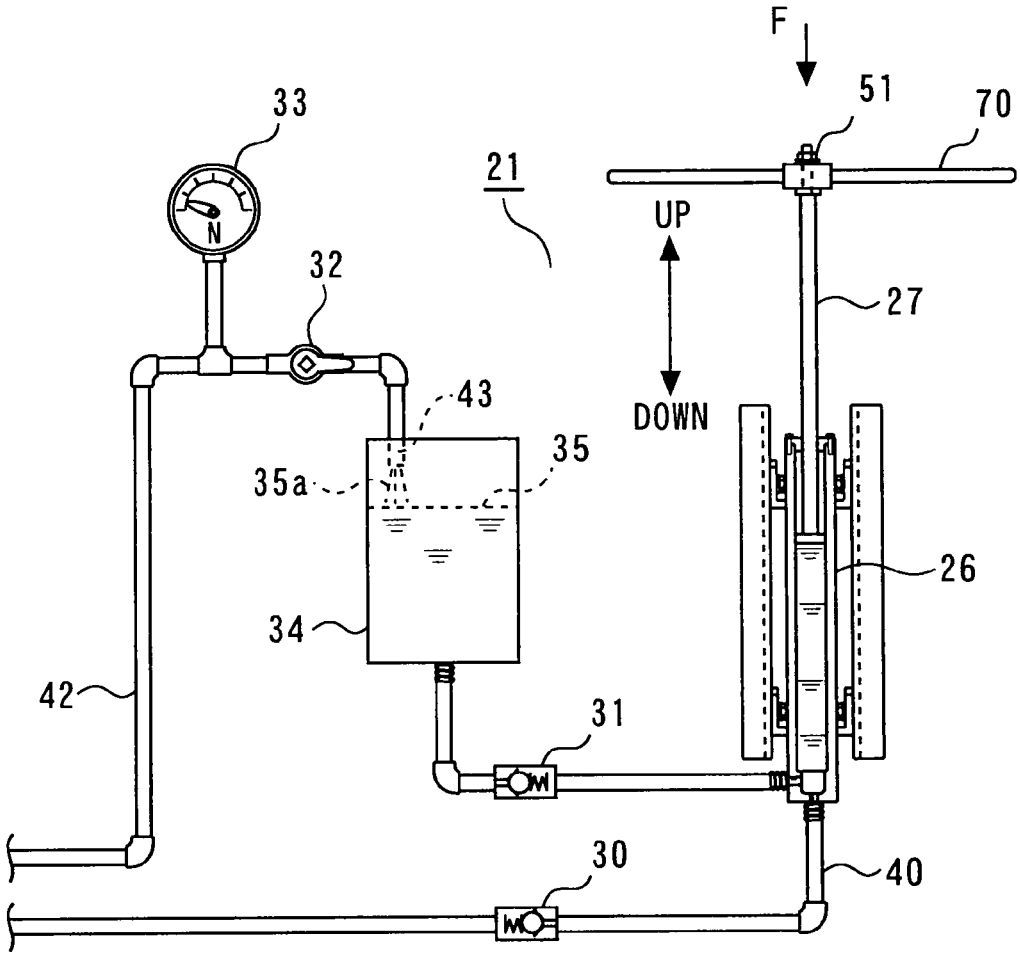
FIG. 12 is a side view of the pressure device section to explain the assembling and adjustment procedures of a step chain tensioning device.
Figure 13:
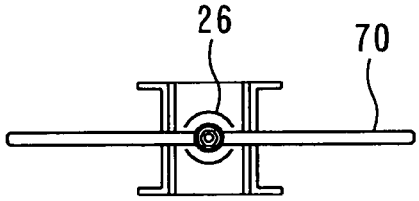
FIG. 13 is a plan view of FIG. 12 as viewed from the direction of the arrow F.

FIG. 1 is a general side view to explain the rough construction of a general passenger conveyor. FIG. 2 is a general side view showing the rough construction of a passenger conveyor in Embodiment 1 of the present invention. FIG. 3 is side view showing a general block diagram showing a step chain tensioning device of a passenger conveyor in Embodiment 1 of the present invention. FIG. 4 is a side view showing the detailed configuration of a tensioning device section of a step chain tensioning device. FIG. 5 is a front view of a tensioning device section as viewed from the lower truss-end side. FIG. 6 is a sectional view taken along the line A-A of FIG. 4. FIG. 7 is a sectional view taken along the line B-B of FIG. 4. FIG. 8 is a side view showing the detailed configuration of a pressure device section of a step chain tensioning device. FIG. 9 is an enlarged front view of a pressure gauge indicating tensioning force. FIG. 10 is a plan view of FIG. 8 as viewed in the direction of the arrow C. FIG. 11 is a sectional view taken along the line E-E of FIG. 8. FIG. 12 is a side view of the pressure device section to explain the assembling and adjustment procedures of a step chain tensioning device. FIG. 13 is a plan view of FIG. 12 as viewed from the direction of the arrow F.

A general passenger conveyor, such as an escalator, is configured, for example, as shown in FIG. 1. That is, adjacent upper and lower floors are spanned with a main frame (truss) 1 of a passenger conveyor. On both sides of this main frame 1 are provided balustrades 2 in a standing manner. A driving machine 3 is provided in a floor portion of an upper part of the interior of the main frame 1. A driving chain wheel 4 is provided in the vicinity of the driving machine 3 in the floor portion of the upper part of the interior of the main frame 1, and the driving machine 3 and the driving chain wheel 4 are connected together by a driving chain 5. An upper-part step chain wheel 6 is attached to the driving chain wheel 4 coaxially thereto. A lower-part step chain wheel 7 is provided in a floor portion of a lower part of the interior of the main frame 1. An endless step chain 8 that is driven by the above-described driving machine 3 is wound on the upper-part step chain wheel 6 and the lower-part step chain wheel 7, and a plurality of steps 9 are fixed to step shafts (not shown) that are attached to this step chain 8 at given intervals. An endless handrail 10 that moves at the same speed as with the step 9 is provided on the balustrade 2 and driven by a handrail driving device 11. A control panel 12 is provided in the floor portion of the upper part of the interior of the main frame 1, and an upper-part landing entrance 13 and a lower-part landing entrance 14 are provided in the upper and lower floor portions of the main frame 1.

The present invention is characterized in that in the case of the occurrence of elongation in the step chain 8 of the passenger conveyor, the lower-part step chain wheel 7 is moved by a step chain tensioning device, whereby a slack in the step chain 8 is absorbed and the step chain 8 is tensioned with any push-out force.

Generally, in a passenger conveyor, the mounting pitch of the steps 9 is on the order of 400 mm. If the travel of the lower-part step chain wheel 7 that causes a step chain tensioning device to tension the step chain 8 is "½ of the mounting pitch of the steps 9+allowance," then it is possible to remove one step 9 when the step chain 8 elongates and the lower-part step chain wheel 7 has moved to the final end of a lower-part truss end. Therefore, possible travels of the lower-part step chain wheel 7 approximately 220 mm or so are sufficient.

A passenger conveyor in Embodiment 1 of the present invention will be described below with reference to FIG. 2 to FIG. 13.

The reference numeral 7 denotes a lower-part step chain wheel provided on both sides of a floor portion of a lower part of the interior of the main frame 1, the reference numeral 8 denotes a step chain wound on the lower-part step chain wheel 7, the reference numeral 20 denotes a tensioning device section of a step chain tensioning device provided in the floor portion of the lower part of the interior of the main frame 1, and the reference numeral 21 denotes a pressure device section of a step chain tensioning device provided in a floor portion of an upper part of the interior of the main frame 1.

First, the configuration of the tensioning device section 20 of the step chain tensioning device will be described with reference to FIG. 3 and FIGS. 4 to 7. The reference numeral 22 denotes a lower-part step chain wheel shaft, the reference numeral 23 denotes a block, the reference numeral 23*a* denotes a screw hole of the block 23, the reference numeral 23*b* denotes a notch provided on a bottom surface of the block 23, the reference numeral 24 denotes a hydraulic cylinder, the reference numeral 24*a* denotes an air vent hole of the hydraulic cylinder 24, the reference numeral 25 denotes a rod connected to a piston of the hydraulic cylinder 24, the reference numeral 25*a* denotes a chamfer of the rod 25, the reference numeral 60 denotes a support metal fitting, the reference numeral 61 denotes a guide metal fitting, the reference numeral 62 denotes a mounting plate, the reference numeral 63 denotes a nut, and the reference numeral 67 denotes a bolt.

On both sides of the main frame (truss) 1, the support metal fitting 60 is horizontally mounted in a fixed manner in the longitudinal direction of the passenger conveyor, and the nut 63 is mounted in a fixed manner on a bottom surface of a hole provided in the support metal fitting 60. The guide metal fitting 61 having a roughly U-shaped sectional shape is placed on a top surface of the support metal fitting 60, and fixed by screwing the bolt 67 into the nut 63 from above. A peripheral portion of the hydraulic cylinder 24 and the guide metal fitting 61 are mounted in a fixed manner by the mounting plate 62. The nut 63 is mounted in a fixed manner on the bottom surface of the hole provided in the support metal fitting 60. A mounting hole is provided in the guide metal fitting 61 so that the position of this hole coincides with the above-described hole provided in the support metal fitting 60. The block 23 is supported by being fitted onto the step chain wheel shaft 22 of the lower-part step chain wheel 7 from right and left. The screw hole 23*a* for screwing and fixing the rod 25 onto the block 23 on the intermediate inclined portion side of the passenger conveyor is provided, and an leading end portion of the rod 25 is screwed into this screw hole 23*a* and fixed thereto. The rod 25 is provided with the chamfer 25*a* on which a spanner and the like are to be put during screwing. The hydraulic cylinder 24 is provided with the air vent hole 24*a*. As shown in FIG. 5, the guide metal fitting 61 has a roughly U-shaped sectional shape, and lateral shifts of the block 23, i.e., the lower-part step chain wheel 7 are restricted by rising portions of the guide metal fitting 61 on both sides, with the result that the block 23 slides on an inner surface of the guide metal fitting 61. In order to prevent interference with the bolt 67 during the sliding on the inner surface of the guide metal fitting 61, the notch 23*b* is provided on the bottom surface of the block 23.

Next, the configuration of the pressure device section 21 of the step chain tensioning device will be described with reference to FIG. 3 and FIGS. 8 to 11. The reference numeral 26 denotes a pressure piston, the reference numeral 27 denotes a rod connected to the pressure piston 26, the reference numeral 28 denotes a weight, and the reference numeral 30 denotes a check valve. This check valve opens under a very small pressure on the order of 10000 Pa (pascals) (≅0.1 kgf/cm$^2$) and is connected so that the valve opens in the direction of the arrow a and closes in the direction of the arrow b. The reference numeral 31 denotes a check valve. This check valve opens under a very small pressure on the order of 10000 Pa (pascals) (≅0.1 kgf/cm$^2$) and is connected so that the valve opens in the direction of the arrow c and closes in the direction of the arrow d. The reference numeral 32 denotes a manual open/close valve, the reference numeral 33 denotes a pressure gauge indicating a tensioning force, and the reference numeral 34 denotes a hydraulic oil tank. The tank is made of a transparent resin so that the interior can be seen. The reference numeral 35 denotes a hydraulic oil, the reference numerals 40, 41, 42 and 43 denote a piping pipe that connects equipment between the tensioning device section 20 and the pressure device section 21, the reference numeral 50 denotes an Ω-shaped weight mounting metal fitting, the reference numeral 51 denotes a nut, the reference numeral 52 denotes a weight mounting bar, the reference numeral 53 denotes a nut, the reference numeral 55 denotes a guide mounting metal fitting having a roughly U-shaped cross section, the reference numeral 56 denotes a weight guide having a roughly U-shaped cross section, the reference numeral 57 denotes a stud bolt, and the reference numeral 58 denotes a nut.

A top-end middle portion of the Ω-shaped weight mounting metal fitting 50 is mounted on a top end portion of the rod 27 of the pressure piston 26 and fastened with the nut 51 from above. On the bottom of the weight mounting metal fitting 50 on both sides, the weight mounting bar 52 is mounted in a fixed condition so as to stand vertically. A plurality of weights 28, each of which is fabricated with any thickness and in the middle of which a hole through which the weight mounting bar 52 is to be inserted is made, are inserted onto the weight mounting bar 52 and stacked on the weight mounting metal fitting 50. The stacked weights are fastened with the nut 53 from the top end portion of the weight mounting bar 52. The guide mounting metal fitting 55 having a roughly U-shaped cross section is mounted on the periphery of the pressure piston 26, and the weight guide 56 which has a roughly U-shaped sectional shape and to the bottom of which the stud bolt 57 is mounted, is mounted to the guide mounting metal fitting 55 with the nut 58. The above-described configuration enables the weight mounting metal fitting 50 loaded with the weights 28 to be guided by the weight guide 56 so as to be able to descend.

As shown in FIG. 3, if the diameter of the pressure piston 26 is denoted by D1, the piston diameter of the hydraulic cylinder 24 is denoted by D2 and the load applied to the pressure piston 26 is denoted by W1, then the push-out force (step chain tensioning force) of the hydraulic cylinder 24 is expressed as $W2=W1\times(D2^2/D1^2)$.

Therefore, if the ratio of D2 to D1 is increased, the load W1 applied to the pressure piston 26 is a very small load and a large tensioning force (push-out force) W2 can be obtained under this load.

Also, by constantly applying a load, i.e., the weight 28 to the pressure piston 26, a constant tensioning force is constantly given. Furthermore, as shown in FIG. 2, by applying pressure from one pressure piston in one place to right and left hydraulic cylinders, a tensioning force (push-out force) W2 that is constant in the right and left sides is applied to the step chain 8.

Next, the assembly and adjustment procedures of the step chain tensioning device will be described with reference to FIGS. 12 and 13.

First, it is assumed that the rod 25 of the hydraulic cylinder 24 of the tensioning device section 20 is in a retracted condition (in a condition in which the hydraulic oil 35 has not entered as yet). Furthermore, it is assumed that the hydraulic oil 35 has been supplied to the hydraulic oil tank 34 of the pressure device section 21 and that the manual open-close valve 32 is in the "Open" position. And as shown in FIG. 12, a handle 70 is attached to the top end portion of the rod 27 of the pressure piston 26 and fastened with the nut 51. Next, the operator grips the handle 70 and causes the rod 27 of the pressure piston 26 to reciprocate in the up-and-down direction (UP, DOWN) in the same manner as when tires of a bicycle are inflated with an inflator. At this time, the numerical value indicated by the indicator of the pressure gauge 33 is low as shown in FIG. 12. When the rod 27 is drawn up, the hydraulic oil 35 in the hydraulic oil tank 34 is sucked into the pressure piston 26. When the rod 27 is pushed down, the hydraulic oil 35 in the pressure piston 26 is fed under pressure into the hydraulic cylinder 24. When the operation by a manual pumping action that causes the rod 27 of the pressure piston 26 to reciprocate in the up-and-down direction as described above is repeatedly performed, the hydraulic oil 35*a* finally returns from the piping pipe 43 to the hydraulic oil tank 34. When it has been ascertained that air is not mixed in the hydraulic oil 35*a* coming out of the piping pipe 43, the manual open-close calve 32 is set to the "Close" position, with the rod 27 of the pressure piston 26 kept in a drawn-up condition. After that, the handle 70 is removed, and as shown in FIG. 8, the weight mounting metal fitting 50 is mounted and the weights 28 are loaded onto the weight mounting metal fitting 50. The quantity of the weights 28 is adjusted so that the tensioning force (push-out force) indicated by the pressure gauge 33 indicating tensioning force shown in FIGS. 8 and 9 becomes any appropriate value. Incidentally, it is assumed that the indication label of the pressure gauge 33 that indicates tensioning force has been replaced with that for which the pressure in the hydraulic cylinder 24 is converted into tensioning force. By adjusting the quantity of the weights 28, it is possible to change the tensioning force of the step chain 8. When the step chain 8 elongates, the pressurized hydraulic oil 35 in the pressure piston 26 is fed under pressure into the hydraulic cylinder 24 (the pressure piston 26 descends) and, therefore, a constant tensioning force is constantly applied. Furthermore, in a case where the step chain 8 elongates and the pressure piston 26 has descended to the lowest part, when the rod 27 of the pressure piston 26 is lifted, with the weights 28 kept attached, the hydraulic oil 35 is sucked from the hydraulic oil tank 34 into the pressure piston 26. When the lifting of the weights 28 is stopped, pressure is applied to the hydraulic oil 35 and a constant tightening force is applied by the hydraulic cylinder 24.

Embodiment 1 described above is an example in which the pressure device section 21 is installed within an upper-part machine room of the main frame (truss) 1. However, even when the distance between the pressure device section 21 and the lower-part step chain wheel 7 is long, the volume is little changed by the application of a high pressure in general cases of the liquid such as a hydraulic oil and the pressure from the pressure piston part to the hydraulic cylinder part is instantaneously transmitted. Therefore, this poses no functional problem in the least. Furthermore, because a control panel and the like are installed in the upper-part machine room, by centralizing things to be maintained and inspected in one place, it is possible to raise the efficiency of maintenance and inspection work.

Embodiment 2

Figure 14:
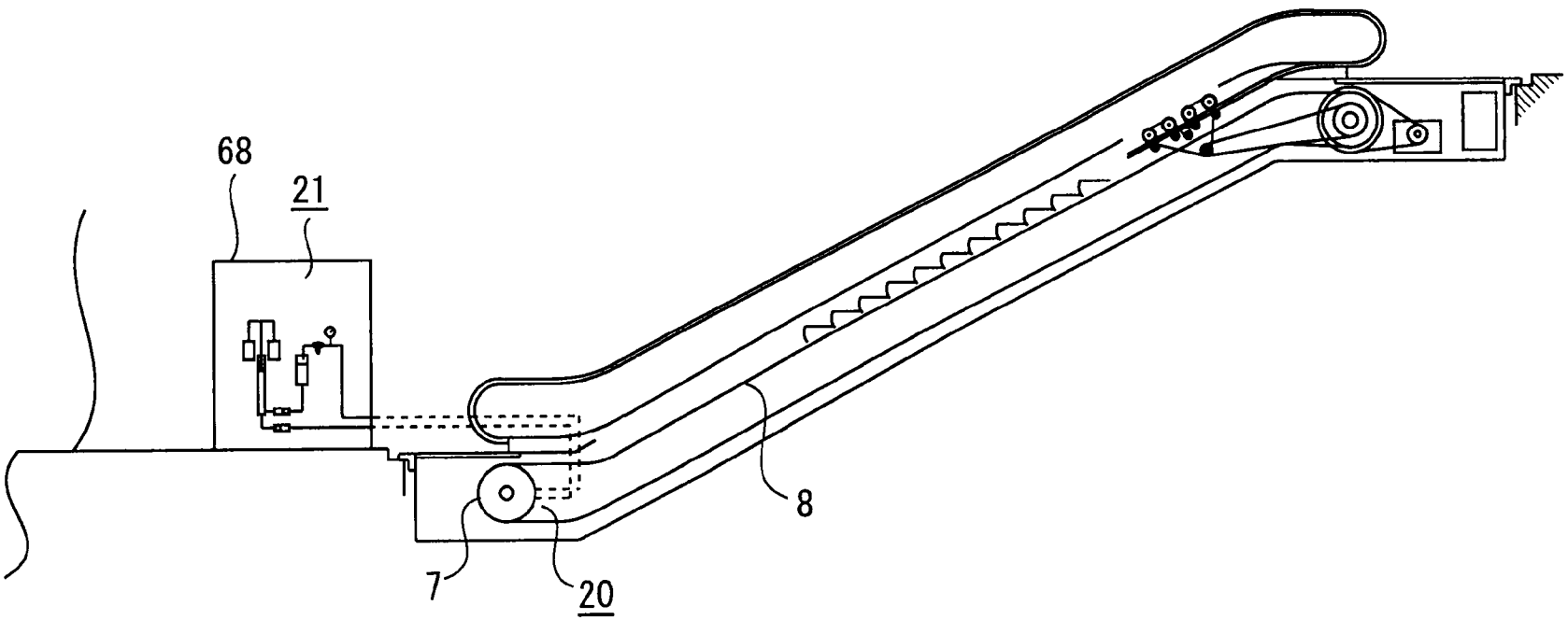
FIG. 14 is a general side view showing the rough construction of a passenger conveyor in Embodiment 2 of the present invention.

FIG. 14 is a general side view showing the rough construction of a passenger conveyor in Embodiment 2 of the present invention.

Embodiment 2 is an example in which a pressure device section 21 is installed in a maintenance/inspection room 68 that is one of the rooms of the building. Because the pressure device section 21 and a tensioning device section 20 of a step chain tensioning device is connected by a piping pipe, it is possible to arrange the pressure device section 21 in a place that permits easy maintenance and inspection as required. It is not always necessary that the pressure device section 21 be within the passenger conveyor, and the pressure device section 21 is installed in the maintenance/inspection room 68 on the building side. The case where the pressure device section 21 is installed in the maintenance/inspection room 68 on the building side like this produces the advantage that inspection work becomes very easy.

Embodiment 3

Figure 15:
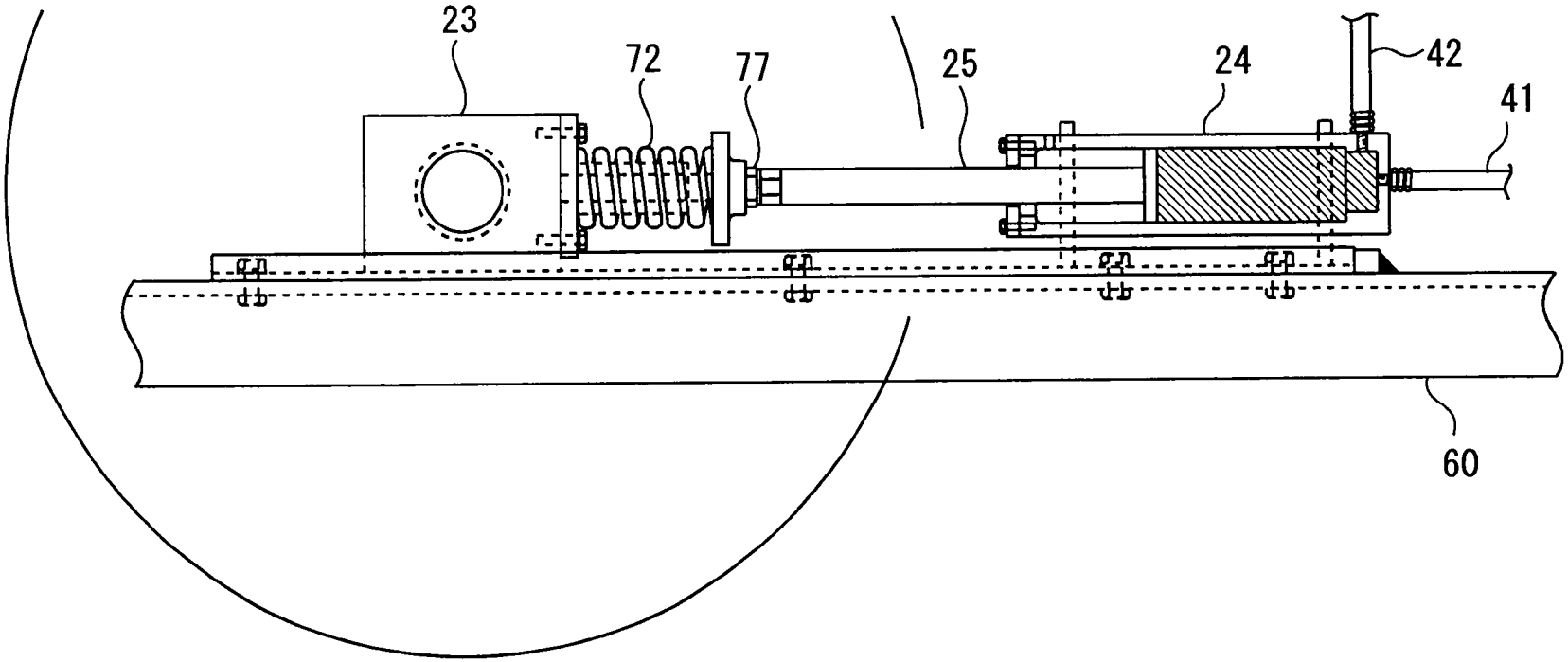
FIG. 15 is a side view showing the detailed configuration of a tensioning device section of a step chain tensioning device in Embodiment 3 of the present invention.
Figure 16:
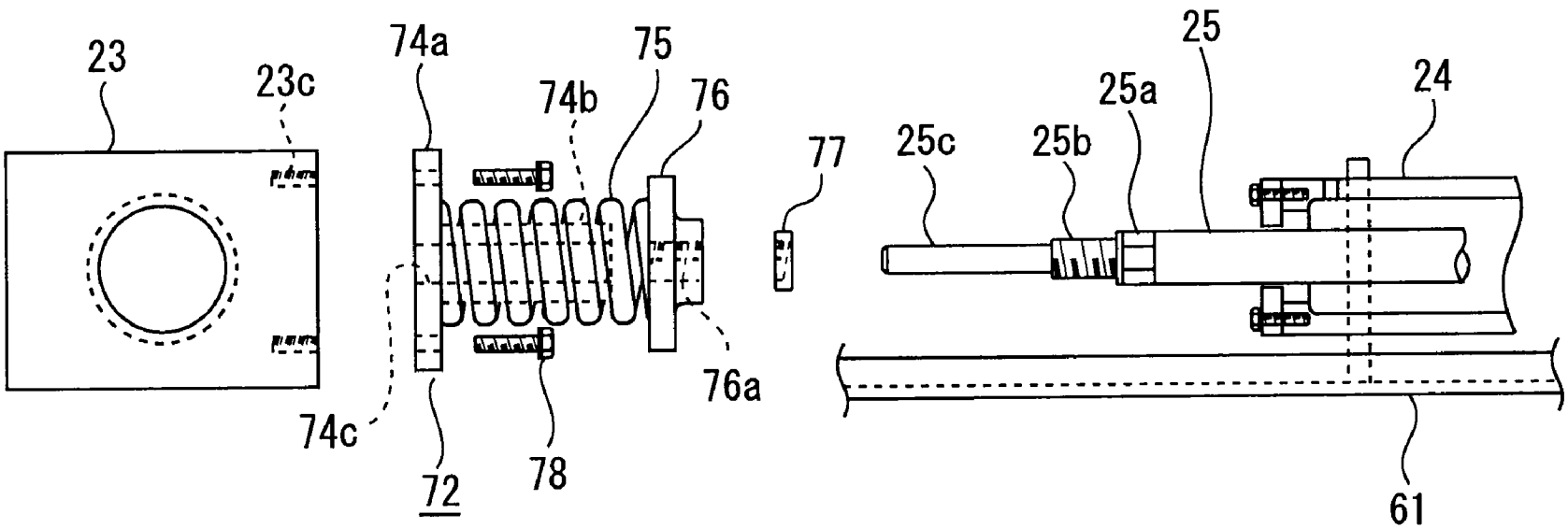
FIG. 16 is a side view showing exploded principal parts of a tensioning device section.

FIG. 15 is a side view showing the detailed configuration of a tensioning device section of a step chain tensioning device of the passenger conveyor in Embodiment 3 of the present invention. FIG. 16 is a side view showing exploded principal parts of a tensioning device section. Incidentally, the same reference characters refer to the same or corresponding parts as in Embodiment 1 and descriptions of these parts are omitted.

In the figures, the reference numeral 23*c* denotes a screw hole provided in a block 23, the reference numeral 25*b* denotes a screw portion provided in a rod 25, the reference numeral 25*c* denotes a slide shaft portion provided in the rod 25, the reference numeral 72 denotes a buffer holder, the reference numeral 74 denotes a holder, the reference numeral 74*a* denotes a base portion of the holder 74, the reference numeral 74*b* denotes a guide portion of the holder 74, the reference numeral 74*c* denotes a guide hole of the holder 74, the reference numeral 75 denotes a spring, the reference numeral 76 denotes a holder, the reference numeral 76*a* denotes a screw hole of the holder 76, the reference numeral 77 denotes a lock nut, and the reference numeral 78 denotes a bolt.

In the same way as with Embodiment 1, a chamfer 25*a* on which a spanner and the like are to be put during screwing is provided in a leading end portion of the rod 25. A screw portion 25*b* is provided on the leading end side of the chamfer 25*a* of the rod 25, and a slide shaft portion 25*c* is provided on the leading end side of the screw portion 25*b*. The cylindrical guide portion 74*b* protrudes from the base portion 74*a* of the holder 74. In the middle of the holder 74, the slide shaft portion 25*c* in the leading end portion of the rod 25 is inserted and the guide hole 74*c* that guides the slide shaft portion 25*c* in the longitudinal direction of the passenger conveyor in a slidable manner is provided. One end of the spring 75 is mounted in a fixed manner on the base portion 74*a* of the holder 74, and the other end of the spring 75 is mounted in a fixed manner on the holder 76. The spring 75 has enough proof stress against a maximum press force by the hydraulic cylinder 24.

The above-described parts are assembled as below. First, the buffer holder 72 in which the holder 74, the spring 75 and the holder 76 are set as one piece is attached to the screw hole 23*c* of the side surface of the block 23 by using the bolt 78. A lock nut 77 is screwed beforehand onto the screw portion 25*b* in the leading end portion of the rod 25. Next, the slide shaft portion 25*c* in the leading end portion of the rod 25 is inserted into the guide hole 74*c* of the holder 74, the rod 25 is rotated, and the screw portion 25*b* on the leading end side of the rod 25 is screwed into the screw hole 76*a* of the holder 76 and then fastened with the lock nut 77. In the above-described assembling, the hydraulic cylinder 24 and the block 23 are integrally assembled.

The tensioning device section 20 constructed as described above in Embodiment 3 has the following features.

When the rod 25 of the hydraulic cylinder 24 presses the spring 75 with any press force, the spring 75 is compressed in a condition in which the above-described any press force and the reaction force of the spring 75 are balanced. Furthermore, the tension of the step chain 8 varies due to variations in the passengers of the passenger conveyor, the tensioning device also moves very slightly back and forth and oscillates. Therefore, by interposing the spring 75 between the rod 25 of the hydraulic cylinder 24 and the block 23, it is possible to absorb the shock due to variations in the tension during the oscillation, thereby producing the advantage that the reversal of the steps can be smoothly performed.

Embodiment 4

Figure 17:
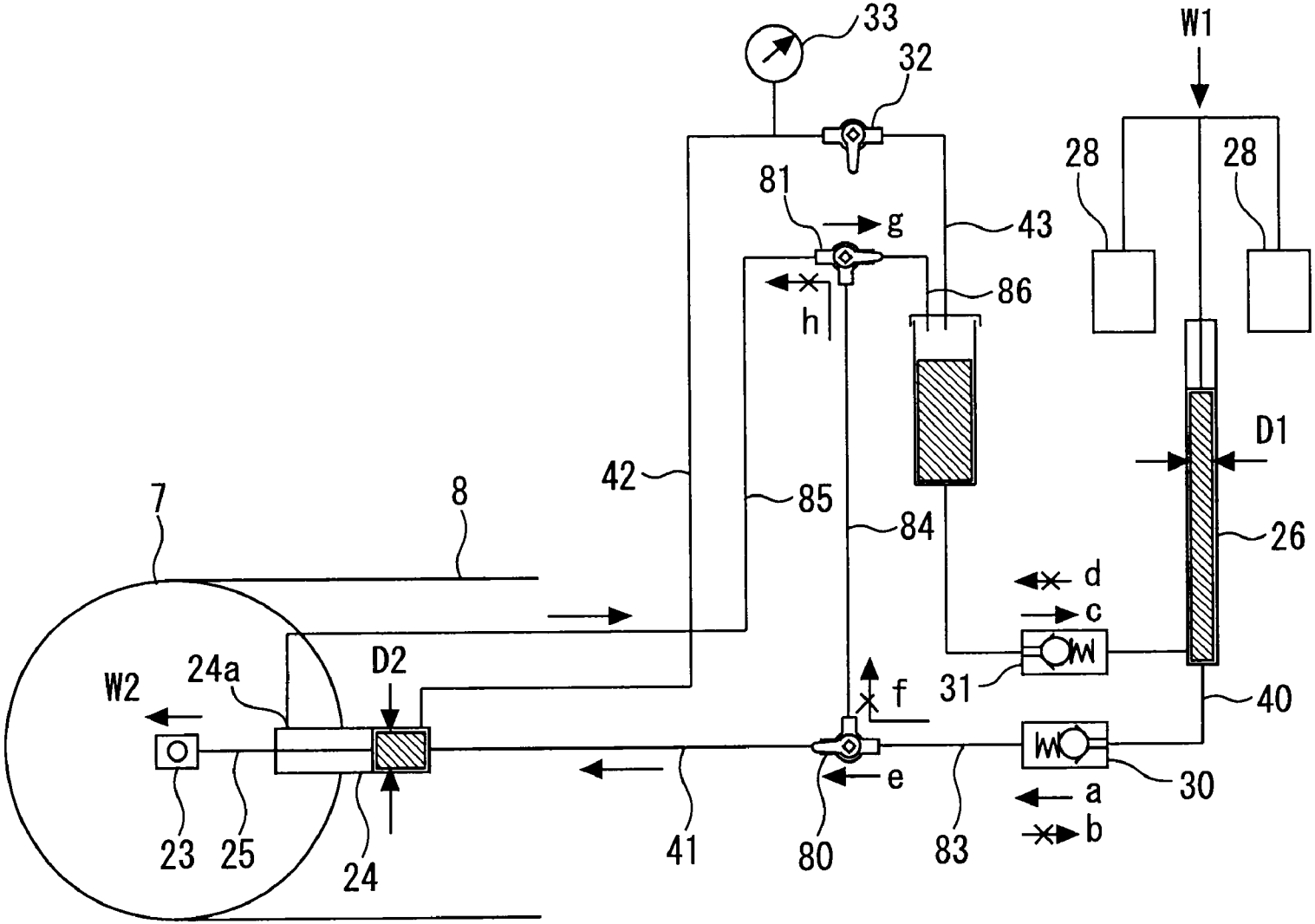
FIG. 17 is a general block diagram showing a normal condition of a step chain tensioning device of a passenger conveyor in Embodiment 4 of the present invention.
Figure 18:
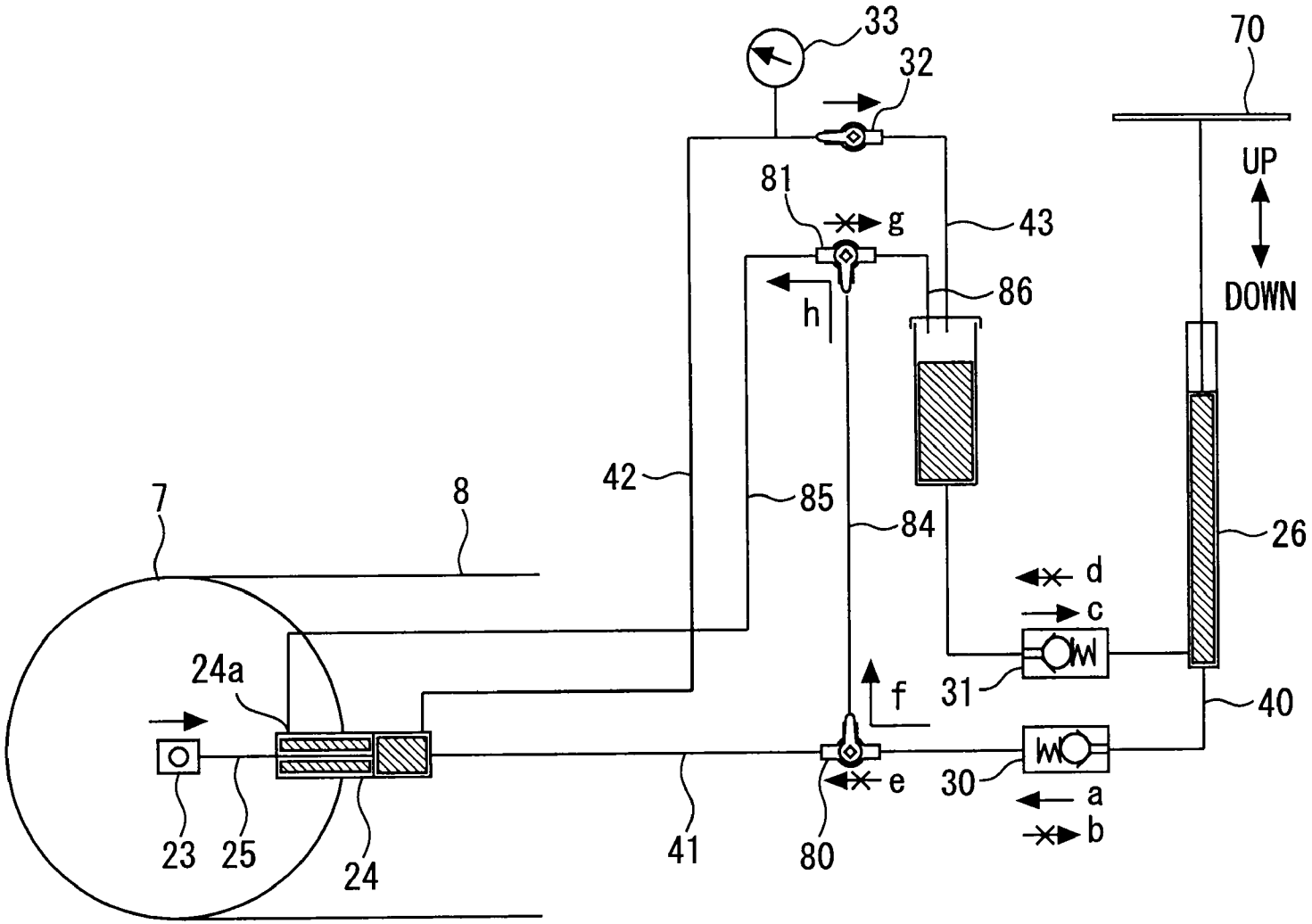
FIG. 18 is a general block diagram showing the condition of a step chain tensioning device of a passenger conveyor during adjustment work in Embodiment 4 of the present invention.

FIG. 17 is a general block diagram showing a normal condition of a step chain tensioning device of a passenger conveyor in Embodiment 4 of the present invention. FIG. 18 is a general block diagram showing the condition of a step chain tensioning device of a passenger conveyor during adjustment work in Embodiment 4 of the present invention. Incidentally, the same reference characters refer to the same or corresponding parts as in Embodiment 1 and descriptions of these parts are omitted.

In the figures, the reference numeral 24*a* denotes an air vent hole of a hydraulic cylinder 24, the reference numeral 80 denotes a first flow-direction changeover valve, the reference numeral 81 denotes a second flow-direction changeover valve, and the reference numeral 83, 84, 85 and 86 denote a piping pipe.

The first flow-direction changeover valve 80 is provided between a check valve 30 and the hydraulic cylinder 24, and the check valve 30 and the first flow-direction changeover valve 80 are connected together by the piping pipe 83. The air vent hole 24*a* of the hydraulic cylinder 24 and a hydraulic oil tank 34 are connected together by the piping pipe 85, and the second flow-direction changeover valve 81 is provided halfway between the two. The first flow-direction changeover valve 80 and the second flow-direction changeover valve 81 are connected together by the piping pipe 84.

The first flow-direction changeover valve 80 can change the flow direction to the direction e and the direction f of FIG. 17, and in FIG. 17, the flow direction is changed so that the hydraulic oil flows in the direction e. The second flow-direction changeover valve 81 can change the flow direction to the direction g and the direction h of FIG. 17, and in FIG. 17, the flow direction is changed so that the hydraulic oil flows in the direction g. In the condition of FIG. 17, as with Embodiment 1, air discharged from the air vent hole 24*a* of the hydraulic cylinder 24 comes out of the piping pipe 86.

In FIG. 18, weights 28 mounted on a pressure piston 26 are removed and attached to a manual handle 70, a manual changeover valve 32 is changed to the "Open" position, the flow direction of the first flow-direction changeover valve 80 is changed over to the direction f, and the flow direction of the second flow-direction changeover valve 81 is changed over to the direction h. With the valves changed over as described above, the rod 27 of the pressure piston 26 is caused to reciprocate in the up-and-down direction (UP, DOWN) in the same manner as when tires of a bicycle are manually inflated with an inflator by a handle 70 attached to the pressure piston 26. Then, pressure is applied from the air vent hole 24*a* of the hydraulic cylinder 24 and the hydraulic oil 35 is fed under pressure into the hydraulic cylinder 24 and the hydraulic oil on the counter air vent hole 24*a* side flows through the piping pipe 42 and the manual changeover valve 32 and is returned into the hydraulic oil tank 34.

In a case where the step chain 8 elongates and the lower-part step chain wheel 7 has moved to a limit of the range of movement of the tensioning device, one of the steps 9 is removed and in order to cut short the step chain 8 by one step, it is necessary to return the rod 25 of the hydraulic cylinder 24 to its original state, thereby returning the lower-part step chain wheel 7 to the intermediate inclined portion side. In this case, if the lower-part step chain wheel 7 is to be moved by human power, this work imposed great burden on the worker because of the heaviness of the lower-part step chain wheel 7 and required much time.

According to Embodiment 4, it is possible to uniformly move the lower-part step chain wheels 7 on the right and left sides to the opposite truss-end side with a small force by use of the pressure piston 26, thereby reducing the burden on the worker. In addition, the work can be performed in a place apart from the tensioning device section, producing the advantage that the work is safer. Also in this case, no power source is required.

Embodiment 5

Figure 19:
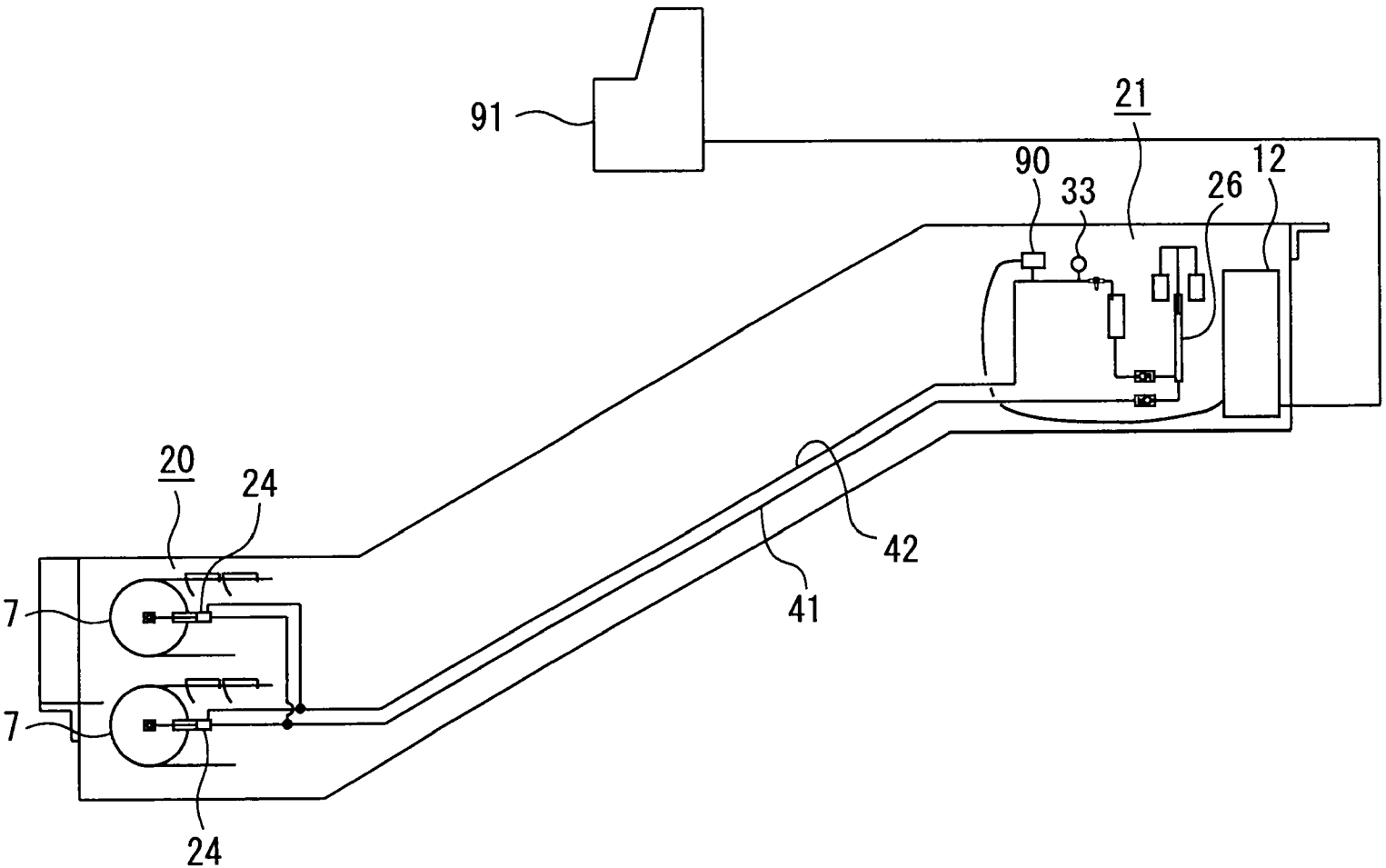
FIG. 19 is a general block diagram showing the rough construction of a passenger conveyor in Embodiment 5 of the present invention.

FIG. 19 is a general block diagram showing the rough construction of a passenger conveyor in Embodiment 5 of the present invention. Incidentally, the same reference characters refer to the same or corresponding parts as in Embodiment 1 and descriptions of these parts are omitted.

In the figure, the reference numeral 90 denotes a pressure detection switch and the reference numeral 91 denotes a warning panel.

The pressure detection switch 90 is connected to a piping pipe 42 in the vicinity of a pressure gauge 33. A signal of the pressure detection switch 90 is transmitted to a control panel 12, and from the control panel 12, information based on the signal of the pressure detection switch 90 is further transmitted to a warning panel 91. When the pressure detection switch 90 indicates a pressure outside any pressure range, the signal of the pressure detection switch 90 is transmitted to a control panel 12 and the pressure detection switch 90 makes an alarm to be known by the warning panel 91 on the basis of the signal. For example, when the pressure is abnormally low, the pressure detection switch 90 performs control, such as causing the passenger conveyor to be stopped. In FIG. 19, the pressure detection switch 90 is connected to the piping pipe 42 in the vicinity of the pressure gauge 33 that indicates tensioning force. However, the pressure detection switch 90 may be connected to any place, such as the piping pipe 41, the piping pipe 42 and the hydraulic cylinder 24 part, so long as the push-out force by the pressure piston 26 is applied to the place.

If for some reason, such as an oil leak, the pressure of the hydraulic oil to the hydraulic cylinder drops, the tension to the step chain drops, causing hindrance to the operation of the passenger conveyor. However, by providing the pressure detection switch 90 and the warning panel 91, in the event of the occurrence of an abnormality, it is possible to perform maintenance and inspection by issuing an alarm and stopping the operation of the passenger conveyor.

INDUSTRIAL APPLICABILITY

As described above, in the passenger conveyor related to the present invention, in the case of the elongation of a step chain, it is possible to cause a hydraulic cylinder of a step chain tensioning device to move a lower-part step chain wheel, whereby a slack in the step chain is absorbed and the step chain is tensioned with any push-out force. The passenger conveyor related to the present invention can be applied to an escalator, a moving walk and the like.

The invention claimed is:

1. A passenger conveyor comprising:

a step chain;

a lower-part step chain wheel; and a step chain tensioning device configured to move the lower-part step chain wheel on which the step chain is wound when the step chain elongates, thereby absorbing a slack in the step chain and tensioning the step chain with any tensioning force, the step chain tensioning device including a tensioning device section having a hydraulic cylinder, the tensioning device section configured to push out the lower-part step chain wheel with a push-out force of the hydraulic cylinder on a side where the step chain is tensioned, and a pressure device section having a pressure piston to which a load by a weight is applied and which causes the hydraulic cylinder of the tensioning device section to provide a constant tension to the step chain via a hydraulic oil due to the pressure of the pressure piston.

2. The passenger conveyor according to claim 1, wherein a plurality of hydraulic cylinders of a tensioning device section provided in a right lower-part step chain wheel and a left lower-part step chain wheel are simultaneously pushed out by use of one pressure piston provided in the pressure device section, whereby the step chain is tensioned.

3. The passenger conveyor according to claim 1, wherein the weight added to the pressure device section can change the pressure of the hydraulic oil by changing the weight of the weight, whereby the tension of the step chain can be changed by changing the push-out force of the hydraulic cylinder.

4. The passenger conveyor according to claim 1, wherein the pressure device section is provided with a pressure gauge that indicates the pressure of the pressurized hydraulic oil.

5. The passenger conveyor according to claim 4, wherein the indication of the pressure gauge is obtained by converting the pressure into the tensioning force of the tensioning device so that the tensioning force can be visually observed.

6. The passenger conveyor according to claim 1, wherein a spring is provided at a leading end of a rod of the hydraulic cylinder of the tensioning device section to ensure that an impact generated by an oscillation due to a load variation of the step chain is absorbed by the spring.

7. The passenger conveyor according to claim 1, further comprising:

a path through which the hydraulic oil is caused to flow in a reverse direction, and a flow direction changeover valve, the path and flow direction changeover valve being provided in a piping path which connects the pressure device section and the tensioning device section and in which the hydraulic oil flows, wherein the hydraulic oil is caused to flow in a reverse direction by manually actuating the pressure device section and the hydraulic cylinder is actuated in a direction reverse to a usual direction so that the lower-part step chain wheel can be moved in a direction in which the lower step chain slackens.

8. The passenger conveyor according to claim 1, wherein the pressure device section causes the pressure piston to be actuated by a manual pumping action until the pressure device section tensions the step chain while removing the slack of the step chain.

9. The passenger conveyor according to claim 1, wherein the pressure device section is provided with a pressure detection switch in a place where the pressure of the pressurized hydraulic oil can be detected, and a signal of the pressure detection switch can be transmitted to a control panel.

10. The passenger conveyor according to claim 9, wherein when a signal outside any pressure range from the pressure detection switch has been detected, an alarm is transmitted from the control panel to a warning panel on the basis of the signal.

11. The passenger conveyor according to claim 1, wherein the pressure device section is installed within a main frame of the passenger conveyor or a maintenance/inspection room of a building.

12. The passenger conveyor according to claim 1, wherein the pressure device section further includes a manual actuator connected to a rod of the pressure piston, wherein, when the manual actuator is actuated, the manual actuator actuates the pressure piston and thereby feeds hydraulic oil into the pressure piston such that the pressure device section tensions the step chain while removing the slack of the step chain.

* * * * *